US005695554A

United States Patent [19]

Landis

[11] Patent Number: 5,695,554

[45] Date of Patent: Dec. 9, 1997

[54] FOUNDRY SAND ADDITIVES AND METHOD OF CASTING METAL, COMPRISING A HUMIC ACID-CONTAINING ORE AND IN-SITU ACTIVATED CARBON OR GRAPHITE FOR REDUCED VOC EMISSIONS

[75] Inventor: Charles R. Landis, Lake in the Hills, Ill.

[73] Assignee: AMCOL International Corporation, Arlington Heights, Ill.

[21] Appl. No.: 668,245

[22] Filed: Jun. 21, 1996

[51] Int. Cl.[6] ..... B22C 1/00; B22C 9/00; B22C 9/02

[52] U.S. Cl. ..... 106/38.2; 106/38.28; 106/38.27; 106/38.22; 502/413; 502/416; 164/529; 164/47; 164/138; 95/141

[58] Field of Search ..... 106/38.2, 28.28, 106/38.27, 38.22; 502/400, 416, 413; 95/90, 141, 283; 164/47, 529, 138

[56] References Cited

U.S. PATENT DOCUMENTS

| | | | |
|---|---|---|---|
| 2,830,342 | 4/1958 | Meyers et al. | 22/193 |
| 2,830,913 | 4/1958 | Meyers et al. | 106/38.9 |
| 3,023,113 | 2/1962 | Barlow | 106/38.8 |
| 3,445,251 | 5/1969 | Nevins | 106/38.3 |
| 3,832,191 | 8/1974 | Bolding et al. | 106/38.3 |
| 3,941,868 | 3/1976 | Riester | 423/210 |
| 4,002,722 | 1/1977 | Suzuki et al. | 423/238 |
| 4,034,794 | 7/1977 | Gebler et al. | 106/38.28 |
| 4,035,157 | 7/1977 | Riester | 23/277 C |
| 4,946,647 | 8/1990 | Rohatgi et al. | 420/528 |
| 5,026,416 | 6/1991 | Alexander | 71/24 |
| 5,034,045 | 7/1991 | Alexander | 71/24 |
| 5,094,289 | 3/1992 | Gentry | 164/529 |
| 5,215,143 | 6/1993 | Gentry | 164/529 |
| 5,275,114 | 1/1994 | Hughes | 106/38.3 |

FOREIGN PATENT DOCUMENTS 843443 6/1970 Canada .

*Primary Examiner*—Michael Marcheschi
*Attorney, Agent, or Firm*—Marshall, O'Toole, Gerstein, Murray & Borun

[57] ABSTRACT

The present invention is directed to a foundry sand additive composition, and method of casting molten metal against a foundry sand containing the additive composition. The additive composition comprises a humic acid-containing and/or a humic acid salt-containing ore (hereinafter referred to separately or in combination as "humic-containing ore") and carbon or graphite or admixtures of carbon and graphite. The combination of carbon and/or graphite and the humic-containing ore react in-situ when the foundry sand is heated by contact with molten metal, at temperatures of about 450° F. to about 2300° F., particularly in the range of about 600° F. to about 2000° F., to activate the carbon and/or graphite. The carbon and/or graphite, activated in-situ during the molding process, absorb and/or adsorb (sorb) gaseous volatile organic compounds (VOCs) within the mold, so that the VOC gases are held by the in-situ-activated carbon and/or graphite to satisfy VOC emissions requirements.

14 Claims, 9 Drawing Sheets

FIG. 7
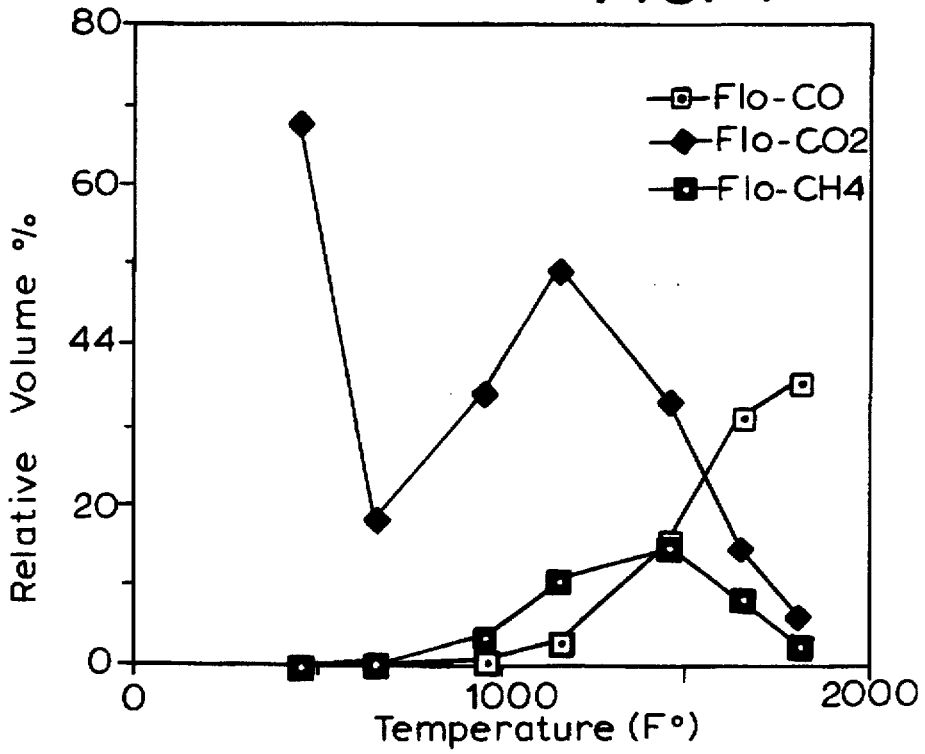
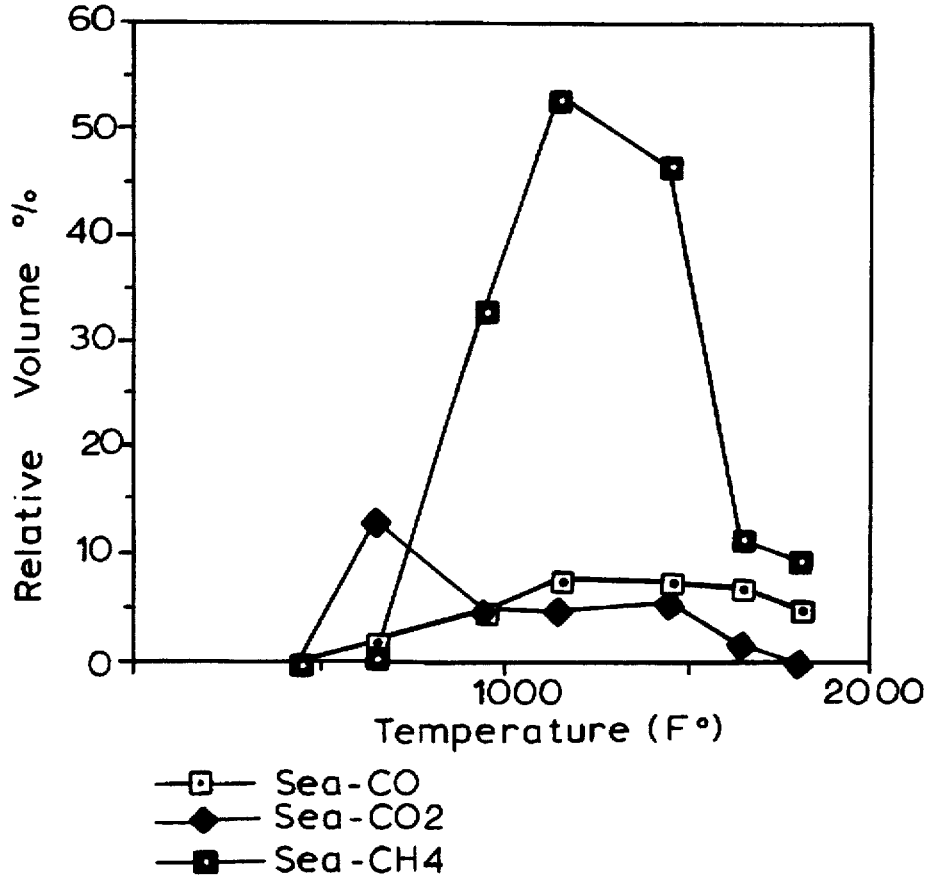
FIG. 8

FOUNDRY SAND ADDITIVES AND METHOD OF CASTING METAL, COMPRISING A HUMIC ACID-CONTAINING ORE AND IN-SITU ACTIVATED CARBON OR GRAPHITE FOR REDUCED VOC EMISSIONS

FIELD OF THE INVENTION

The present invention is directed to a foundry sand additive comprising carbon and/or graphite; and a material selected from the group consisting of humic acid, and any humic acid containing ore, particularly lignite, leonardite, and any coal that meets the specifications for the class designated as Class IV, Lignitic, ASTM Designation D388-38, Classification of Coal by Rank, preferably lignite or leonardite, particularly oxidized lignite and/or oxidized leonardite, as described in this Assignee's U.S. Pat. Nos. 5,034,045 and 5,026,416, hereby incorporated by reference. The combination of carbon and/or graphite and the humic acid-containing ore react in-situ during the molding process, at temperatures above about 450° F., particularly in the range of about 600° F. to about 2300° F., to activate the carbon and/or graphite so that volatile organic compounds (VOCs) that are volatilized during the molding process are more completely sorbed (absorbed and/or adsorbed) by the activated carbon/graphite, activated in-situ, for satisfaction of VOC emissions requirements from the foundry, without the need for expensive gas treatment processes.

BACKGROUND OF THE INVENTION AND PRIOR ART

Regular foundry sands include silica sand, olivine sand, zircon sand and chromite sand. Silica sand accounts for approximately 90% of the sands used in the foundry industry. The other three sands are more thermally stable, but more expensive—zircon being the most thermally stable and most expensive.

Sand molds shape the outside of castings. Cores are sand shapes which are positioned inside the mold to shape the inside of a casting. If a core were not used, the casting would be solid metal and many castings are not solid, but have inside channels or configurations.

Molds are one of two kinds:

(1) "green" sand molds are bentonite (clay)/water bonded sand mixtures rammed against a pattern to form a desired contour (a top half or cope and a bottom half or drag are booked together to form a complete mold cavity). The sand is a tough, pliable mixture which will hold its molded shape. Molten metal is poured into the mold cavity where it solidifies to form the resultant casting.

(2) "rigid" molds are sand mixtures which can be molded against a pattern and then hardened into a rigid condition. The method of hardening depends on the kind of binder used. Although bentonite clay bonded molds can be hardened by air-drying or baking, usually rigid molds are bonded with organic resins which harden into much stronger and harder shapes. Binders are designed to be hardened by several methods. Some are baked; some are cured or hardened by chemical reaction with a reagent; and some are hardened by flushing with a reactive gas.

Cores are usually rigid shapes employing the same kinds of binders and methods described above for rigid molds.

Much as pavement buckles on a hot day, a sand mold or core can buckle due to expansion during the casting operation. The high temperature expansion buckle of the mold wall causes a defect on the casting surface known as a "buckle" or a "scab". If a core expands too much, the core will crack or craze and metal will enter the crack to form an irregular fin of metal on the cored surface of the casting which must be removed. Obviously, less thermal expansion in a sand is a great advantage. U.S. Pat. Nos. 2,830,342 and 2,830,913, are directed to the excellent thermal stability of carbon sands that are useful together with the additives disclosed herein.

Relatively inexpensive silica sand grains bound together with a suitable binder are used extensively as a mold and core material for receiving molten metal in the casting of metal parts. Olivine sand is much more expensive than silica sand but, having better thermal stability than silica sand, provides cast metal parts of higher quality, particularly having a more defect-free surface finish, requiring less manpower after casting to provide a consumer-acceptable surface finish. Olivine sand, therefore, has been used extensively as a mold and core surface in casting non-ferrous parts in particular and has replaced silica sand in many of the non-ferrous foundries in the United States. Olivine sand, silica sand and combinations thereof also are useful together with the additives disclosed herein.

Spherical or ovoid grain, carbon or coke particles, known to the trade as petroleum fluid coke, also have been used as foundry sands where silica sands and olivine sands do not have the physical properties entirely satisfactory for casting metals such as aluminum, copper, bronze, brass, iron and other metals and alloys. Such a fluid coke carbon sand presently is being sold by AMCOL International Corporation of Arlington Heights, Illinois under the trademark CAST-RITE® and has been demonstrated to be superior to silica sand and olivine sand for foundry use. Each of these spherical or ovoid grain fluid coke carbon sands also are useful, alone or in combination with other types of foundry sands, together with the foundry sand additives disclosed herein.

Roasted carbon sand as described in U.S. Pat. No. 5,094,289, hereby incorporated by reference, is a low cost carbon sand designed primarily for low melting temperature metals, such as aluminum and magnesium. Roasting at 1300°–1400° F. will remove all of the volatile matter which would otherwise be evolved if raw fluid coke were exposed to aluminum poured at 1400° F. Other roasted carbon sands, having the porosity eliminated, are described in this Assignee's U.S. Pat. No. 5,215,143, hereby incorporated by reference. These roasted carbon sands also are useful, alone or in combination with other types of foundry sands, together with the additives disclosed herein.

All of the above-described foundry sands, and mixtures thereof, are suitable for admixture with the additives of the present invention.

Although humic acid is derived from several sources, such as lignite, leonardite, peat and manure, the preferred source of humic acid is leonardite. Leonardite, usually found in ore deposits that overlay lignite coal deposits, is a highly oxidized form of lignite containing a higher oxygen content than lignite. The areas of greatest lignite coal oxidation lie along the outcrops at the surface of the leonardite overlay. A prior art patent that discloses the use of lignite or leonardite in foundry sand molds is U.S. Pat. No. 3,832,191.

North Dakota leonardite is defined by the U.S. Bureau of Mines as "essentially salts of humic acids". The humic acid derived from this North Dakota leonardite has been oxidized, leaving sites for cation absorption by the resultant negative charge. This oxidized structure is generally negative charged. This oxidized structure is generally illustrated in FIG. 2 of U.S. Pat. No. 5,034,045, wherein the oxidized sites are depicted by asterisks.

Chemical studies of the composition of leonardite have revealed that it is mainly composed of the mixed salts of acid radicals found in soil humus, a product of the decay of organic matter that contains both humic and nonhumic material. Such acid radicals are collectively termed "humic acids", having individual fractions named humin, humic acid, ulmic acid and fulvic acid. The exact structure of the humic acids are unknown. However, humic acids appear to be associations of molecules forming aggregates of elongated bundles of fibers at low pH, and open flexible structures perforated by voids at high pH. These voids, of varying dimensions, trap organic or inorganic particles of appropriate electronic charge.

Leonardite in its natural state is composed predominantly of insoluble calcium, iron and aluminum humates. The calcium content of leonardite is high, and accordingly, treatment with materials that remove the calcium and form inorganic, insoluble calcium salts increases the water-solubility of the humate.

All humic acid-bearing ores contain inactive ingredients such as clay, shales, gypsum, silica and fossilized organic matter. However, it is desirable to minimize the amount of inactive materials present in the ore. It has been found that the percentage of inactive ingredients is lowest for ores mined from North Dakota leonardite deposit outcrops. For these humic acid-bearing ores, the contaminants account for only approximately 15% by weight of the humic acid-bearing ore. However, the remaining 85% by weight of the ore is not all humic acid. Some of the humic acid content is irreversibly combined with crystallized minerals, and some of the humic acid is polymerized into insoluble molecules, such as the heavier molecular weight analogs of humic acid, like ulmic acid and humin. By adding an oxidizing agent, such as an aqueous solution of hydrogen peroxide, in addition to an alkali hydroxide, to the humic acid-bearing ore to facilitate liberation of the humic acid from the contaminants found in the ore, the inactive portion of the humic acid-bearing ore, including the insoluble and/or inorganic constituents, is allowed to separate and can be filtered from the active, water-soluble alkali metal humic acid salt.

As previously stated, humic acid is a complex material and is comprised of several constituents having a wide range of molecular weights. Humic substances in general are defined according to their solubility and include fulvic acid, humic acid, hymatomelanic acid, ulmic acid and humin. For instance, fulvic acid is a fraction of soil organic matter, that, like humic acid, is soluble in dilute alkalis; but, unlike humic acid, is soluble in mineral acid. It is believed that fulvic acid has a simpler chemical structure than humic acid and is a precursor of humic acid. In accordance with a preferred feature of the present invention, the water-soluble alkali metal salt of humic acid obtained from the alkali metal hydroxide and oxidizing agent treatment of a humic acid-containing ore, containing from about 3% to about 5% fulvic acid, is preferred for use with the carbon or graphite in accordance with the present invention. The medium chain length humic acid constituents are absorbed by carbon and graphite more slowly than the short chain humic acid and fulvic acid constituents. The water-soluble humic acid salts obtained in accordance with U.S. Pat. Nos. 5,026,416 and 5,034,045 contain essentially none of these high molecular weight, insoluble humic acid constituents which are preferred for in-situ carbon or graphite activation.

It is known to add water-soluble salts of humic acid to clay bonded foundry sands. See for example U.S. Pat. No. 3,445,251. It is also known to add a mixture of humic acid and an aqueous emulsion of a high melting point asphaltic pitch to clay bonded foundry sands. See for example, U.S. Pat. No. 3,023,113. Canadian Pat. No. 843,443 discloses the use of alkali metal salts of humic acid as a temporary binder for granular or pulverulent materials, that is, a binder which is capable of being entirely or partially destroyed by a subsequent heating action.

For economic considerations when used in foundry sand molds, the humic acid will generally not be extracted from its source material. The richest common source of humic acid is lignite or leonardite, of which there are vast deposits distributed throughout the world, including the United States, and particularly the states of North Dakota, Texas, New Mexico, and California. Thus, lignite or leonardite, particularly oxidized lignite or oxidized leonardite, is the preferred source of humic acid.

Activated carbon is used extensively to sorb volatile organic contaminants from gases, such as air. Activated carbon filters have been used to filter gases from enclosures surrounding foundry molding processes, as disclosed in U.S. Pat. Nos. 3,941,868 and 4,035,157. Activated carbon and activated graphite, however, are relatively expensive in comparison to the cost of non-activated carbon and graphite and, therefore, they have not been used as an additive in foundry molding sands.

Activated carbon is formed from carbonaceous materials such as coal and leonardite, in one process, by thermal activation in an oxidizing atmosphere. The thermal activation process greatly increases the pore volume and surface area of the carbon particles by elimination of volatile pyrolysis products and from carbonaceous burn-off.

Surprisingly, it has been found that by including a foundry sand mold additive comprising a humic acid-containing or humic acid salt-containing ore; and non-activated carbon or non-activated graphite, together with the foundry sand, oxidation of the carbon or graphite occurs in-situ during the casting of molten metal, and the resulting activated carbon and/or activated graphite sorbs unexpectedly high amounts of volatile organic compounds (VOCs) that are volatilized from the foundry sand composition by the molten metal—thereby eliminating or reducing the need for VOC-elimination treatment of the gases formed during the metal casting process.

SUMMARY OF THE INVENTION

In brief, the present invention is directed to a foundry sand additive composition, and method of casting molten metal against a foundry sand containing the additive composition. The additive composition comprises a humic ore—a humic acid-containing and/or a humic acid salt-containing ore (hereinafter referred to separately or in combination as "humic-containing ore") and carbon or graphite or admixtures of carbon and graphite. The combination of carbon and/or graphite and the humic-containing ore react in-situ when the foundry sand is heated by contact with molten metal, at temperatures of about 450° F. to about 2300° F., particularly in the range of about 600° F. to about 2000° F., to activate the carbon and/or graphite. The carbon and/or graphite, activated in-situ during the molding process, absorb and/or adsorb (sorb) gaseous volatile organic compounds (VOCs) within the mold, so that the VOC gases are held by the in-situ-activated carbon and/or graphite to reduce VOC emissions.

Accordingly, one aspect of the present invention is to provide a foundry sand additive composition, and method of casting molten metal, that provides activated carbon and/or activated graphite, in-situ, for absorption of gaseous organic compounds liberated from the foundry sand, such as benzene, that are volatilized during the metal casting process.

Another aspect of the present invention is to provide a foundry sand composition that includes a foundry sand; a foundry sand binder, such as sodium bentonite clay in an amount of about 1% to about 15% by weight, based on the dry weight of the foundry sand composition; a ground humic acid-containing ore, such as oxidized lignite, e.g., FLOCARB®, sold by this Assignee, in an amount of about 0.1% to about 10% by weight, preferably about 0.1% to about 2% by weight, based on the dry weight of the foundry sand composition; and carbon, graphite or a combination thereof in an amount of about 0.1% to about 10% by weight, preferably about 0.1% to about 2% by weight, in a ratio of about 5/95 to 95/5 by weight ore/carbon and/or graphite. The above and other aspects and advantages of the present invention will become more apparent from the following detailed description of the preferred embodiments of the invention taken in conjunction with the drawings.

BRIEF DESCRIPTION OF THE DRAWINGS

FIG. 7 is a graph showing total CO, $CO_2$ and $CH_4$ generated from FLOCARB® at various metal casting temperatures;

FIG. 8 is a graph showing total CO, $CO_2$ and $CH_4$ generated from SEACOAL at various metal casting temperatures;

DETAILED DESCRIPTION OF THE PREFERRED EMBODIMENTS

Figure 1:
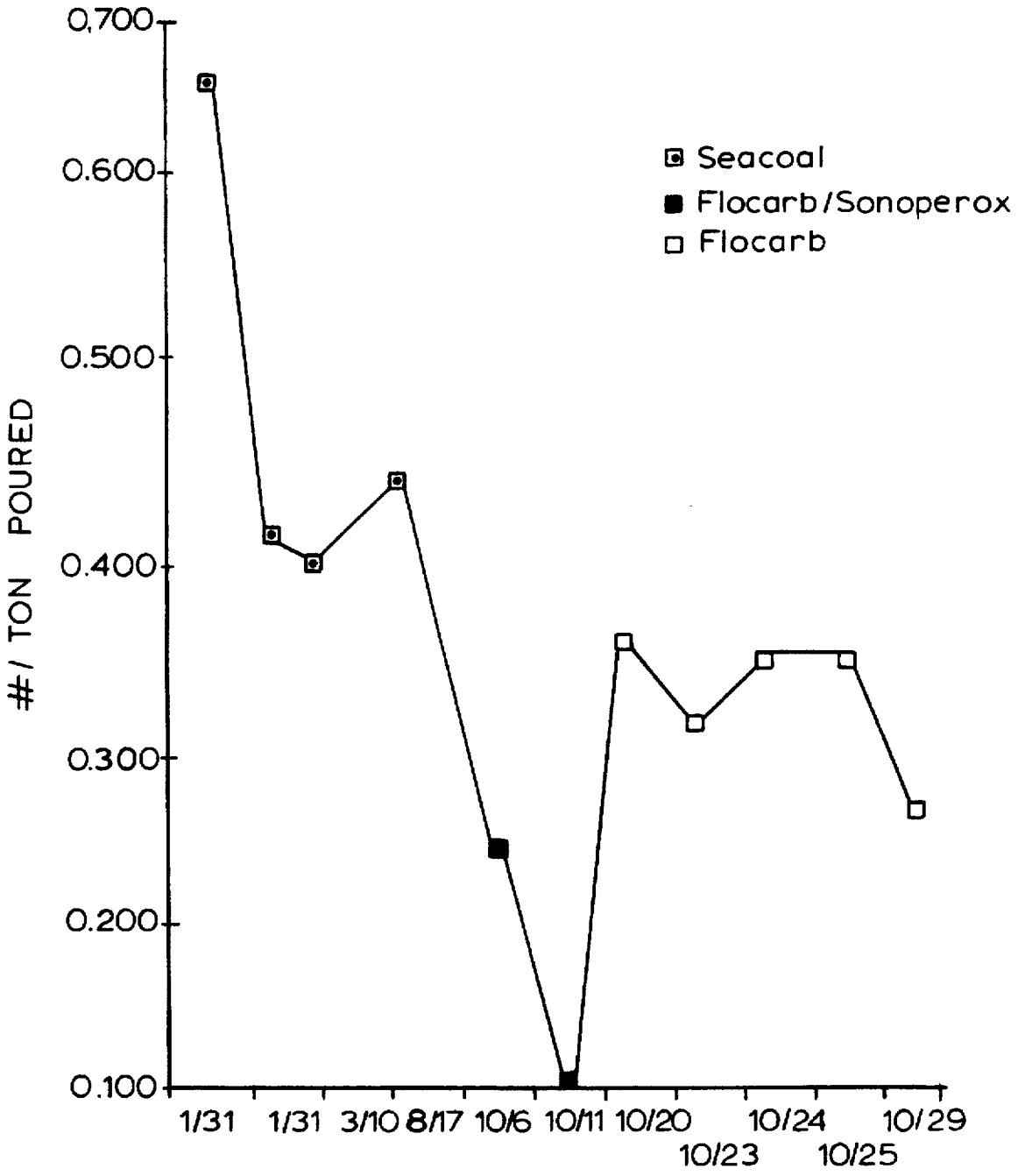
FIG. 1 is a graph comparing foundry sand VOC emissions of FLOCARB® to a common SEACOAL additive.

The present invention is directed to a foundry sand additive comprising a combination of a humic acid-containing ore and carbon or graphite, used together with any other commonly used foundry sand additives, such as a sodium bentonite clay binder. A green sand mold used for casting steel usually consists of silica sand, a clay binder, and/or an organic binding agent mulled together with temper water. Other useful foundry sands include chromite, zircon and olivine sands.

One or more binders mixed with the foundry sand is essential to maintain the sand in a predetermined mold configuration. One of the most commonly employed green sand binders is clay, such as a water-swellable sodium bentonite clay or a low swelling calcium bentonite clay. The amount of the clay binder that is used together with the sand generally depends upon the particular type of sand used in the mixture and the temperature of firing. Silica sand grains expand upon heating. When the grains are too close, the molding sand moves and expands causing the castings to show defects such as "buckles" (a deformity in the casting resulting from excessive sand expansion), "rat tails" (a rough, irregular depression that appears on the surface of a casting or a minor buckle), and "scabs" (a breaking away of a portion of the molding sand when hot metal enters the mold). To overcome this harmful expansion, more clay is added to the sand mixture since the clay contracts upon firing thereby compensating for the expansion of the silica sand grains.

Any binder ordinarily used to bind silica, olivine, chromite, carbon, and/or zircon foundry sands can be used with foundry sand and additives disclosed herein to enable the sand to retain a predetermined or desired shape as a mold or core material. Such binders generally are present in amounts of about 1% to about 15% based on the total dry weight of the foundry sand mixture and may be adjusted to whatever amounts that will produce the desired strength, hardness or other desirable physical properties. Some of the binders which can be used in the foundry sand of this invention include bentonites, other clays, starches, sugars, cereals, core oils, sodium silicates, thermoplastic and thermosetting resins, vapor-curing binders, chemically-curing binders, heat-curing binders, pitches, resins, cements and various others known in the art.

In green sand molding, the reproducibility of the dimensions obtained on the casting are the result of such factors as shrinkage, changes in dimensions of mold cavity, hardness of mold, stability of molding sand, mechanical alignment of flask and maintaining a fixed temperature. Sodium bentonite bonded molding sands have a more gummy feel than southern (calcium) bentonite bonded sand mixtures when the temper water is added and mulled into sand mixtures. Sodium bentonite sand mixtures are said to be "tougher" and not as "brittle" as calcium bentonite or Fuller's Earth bonded molding sands prepared in the same manner. It is also known to treat calcium bentonite with a sodium carbonate treatment, a process known as peptizing, to convert the calcium bentonite to a swelling sodium bentonite. Generally the clay or clay mixture is used in the silica sand in an amount of about 2% by dry weight up to about 15% based on the total dry weight of the foundry sand, generally about 3% to about 10% by weight based on the dry weight of the total sand content. It is understood in the foundry industry that by adding more clay binder to a foundry sand mixture, more water is also required. Therefore, it is often the case that by using less clay binder in a foundry sand mixture and reducing the amount of temper water added, the foundry sand mixture is just as strong as it was with higher percentages of clay binder and water.

Other common additives for foundry sands include cellulose, cereal, or other fibrous additives included for the purpose of overcoming sand expansion defects, particularly those defects occurring on flat casting surfaces, in an amount of about 0.5% to about 5% by weight of dry sand. Typical cellulose additives include wood flour and cereals such as rye flour, wheat flour, corn flour, oat hulls, rice hulls, alfalfa fines, grain chaff, flax seed pressings, corn cob flour, pulverized nut hulls, ground cotton-seed pulp after oil extraction, and the like. Cements, e.g., portland; natural cements, such as heated, ground limestone; resins and the like, in amounts of about 3% to about 6% by weight of the dry sand, also can be added to foundry sand binders in accordance with the principles of the present invention.

Various other additives may be included in the foundry sand, such as various blackings or other carbonaceous materials, such as pitch; charcoal; bituminous coal; or soft coal, such as seacoal; hard coal; and coke which can be used with, or as a partial substitute for carbon or graphite to prevent metal penetration or burn-on; chemical agents, such as resin binders; china clay; oils, such as linseed oil and the like. These additional additives generally are included in amounts of less than about 1.0% by weight of the dry foundry sand and, generally, in an amount of 0% to about 10% by dry weight.

The humic acid-containing ores or humic acid salt-containing ores and the carbon or graphite foundry sand additives used in foundry sand molds and/or foundry sand cores in accordance with the present invention can be powdered or granular, in a particle size preferably below about 1000 μ (16 mesh), more preferably below about 105 μ(150 mesh) and most preferably below about 74 μ(200 mesh), to avoid surface defects in the metal casting. The amount of humic acid-containing ore added to the foundry sand in accordance with the present invention is about 0.1% to about 10%, preferably about 0.1% to about 2%, more preferably about 0.25% to about 0.5% by weight, based on the total dry weight of the foundry sand including additives. The proportion of humic acid-containing ore or humic acid salt-containing ore in relation to the amount of carbon or graphite will vary depending upon the oxidation capacity of the ore.

The highly oxidized leonardite described in this Assignee's U.S. Pat. Nos. 5,034,045 and 5,026,416 are needed in an amount of about 5% to about 20% by weight based on the total weight of humic acid-containing ore plus carbon and/or graphite, but may be included up to about 95% based on the total weight of ore plus carbon or graphite. Less oxidized humic acid-containing or humic acid salt-containing ores such as lignite and coal are generally required in amounts of about 10% to about 95% by weight, preferably about 35% to about 85% by weight, more preferably about 50% to about 80% by weight, based on the total weight of ore plus carbon and/or graphite. The humic acid-containing or humic acid salt-containing ore should contain at least about 5% by weight water, (which ores contain by virtue of being stored in a normal humidity environment) or sufficient water should otherwise be added to the foundry sand to provide at least about 5% water, based on the weight of the ore, to achieve in-situ oxidation of the added carbon and/or graphite to activate the carbon or graphite to increase the surface area of the carbon and/or graphite and increase the capacity of the carbon and/or graphite, in-situ, to sorb foundry sand-liberated organic gases at least about a 10% increase by volume, preferably at least about 20% increase by volume, in comparison to non-activated carbon or non-activated graphite.

The addition of the ground ore together with carbon or graphite will reduce the amount of volatile organic compounds, e.g., benzene, being emitted from the foundry sand mold, in comparison to typically used seacoal blends, by about 20% to about 90% by weight, as shown in FIG. 1.

Figure 2:
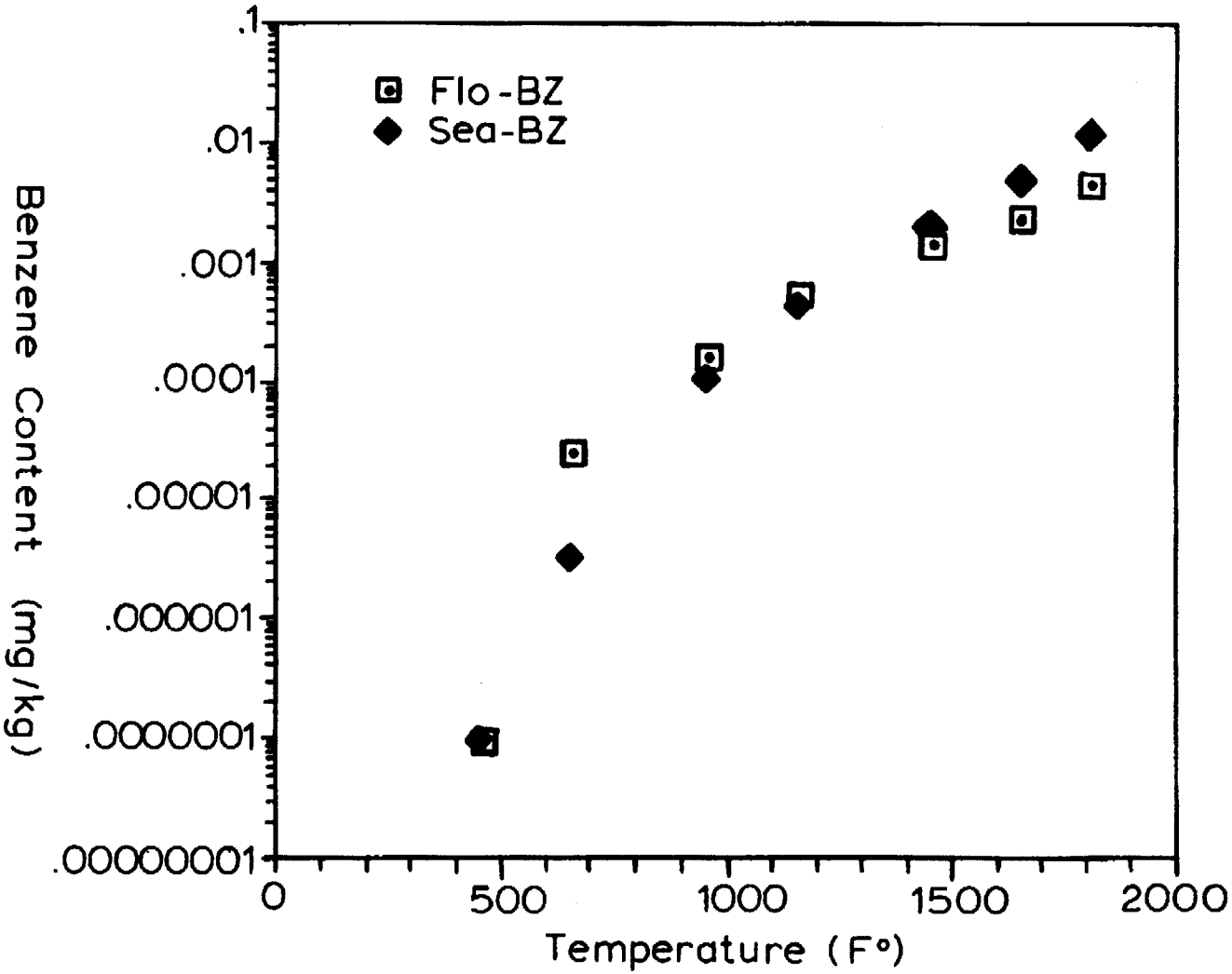
FIG. 2 is a graph of benzene generation with increasing temperature for FLOCARB® and SEACOAL on a log normal scale.
Figure 3:
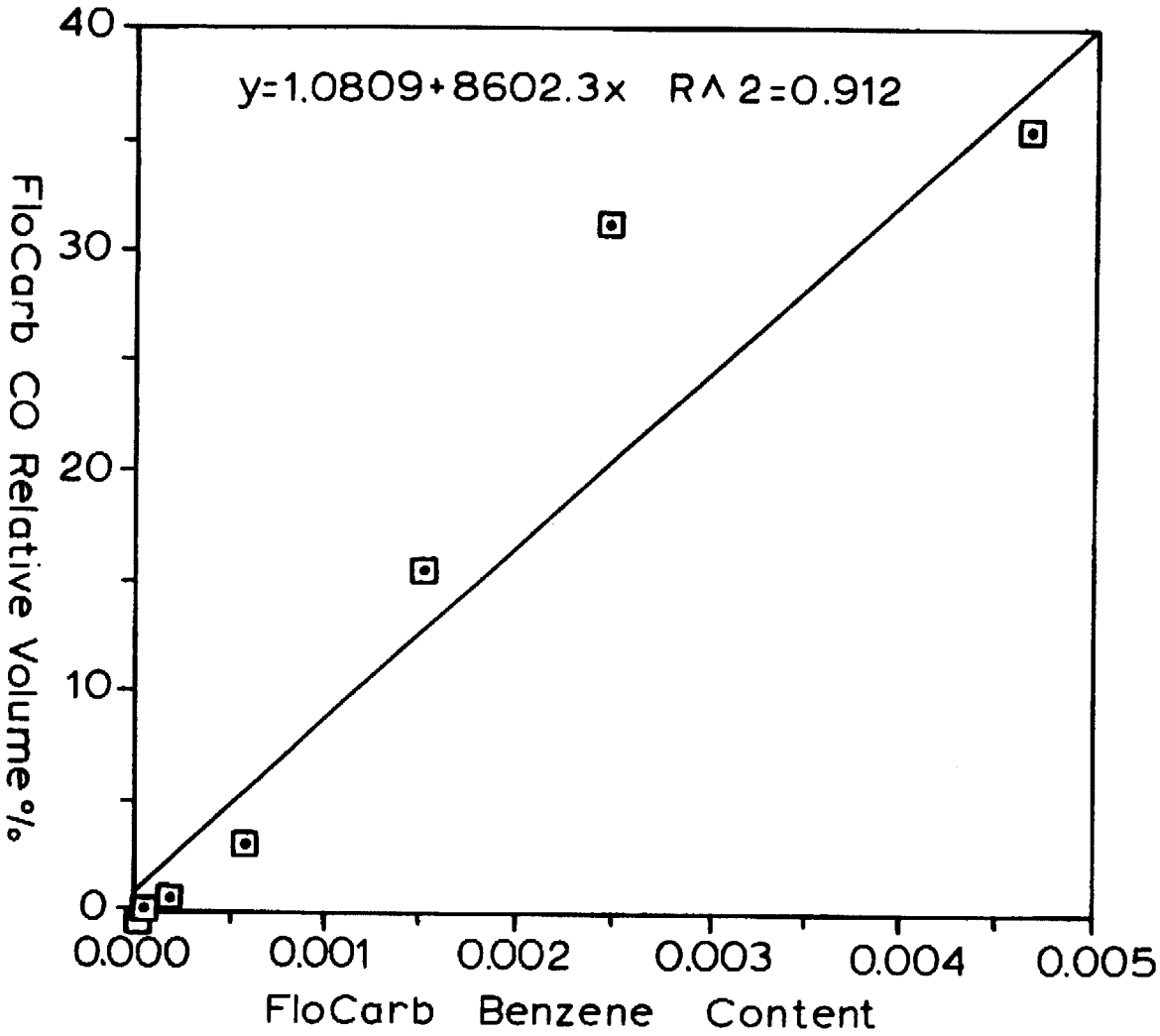
FIG. 3 is graph that correlates the benzene and carbon monoxide (CO) content of FLOCARB®.
Figure 4:
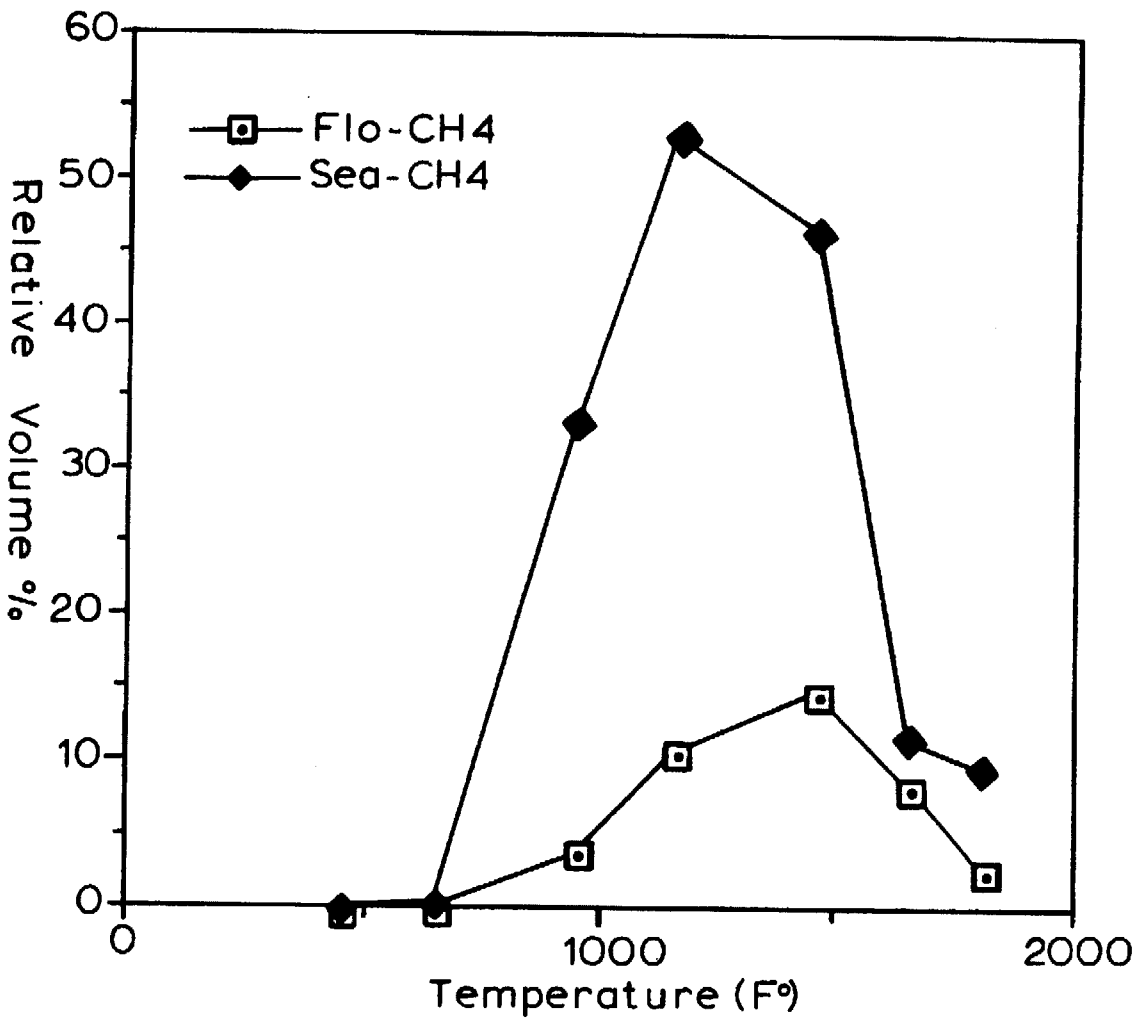
FIG. 4 is a graph that shows the methane ($CH_4$) generated from FLOCARB® and SEACOAL at various metal casting temperatures.
Figure 5:
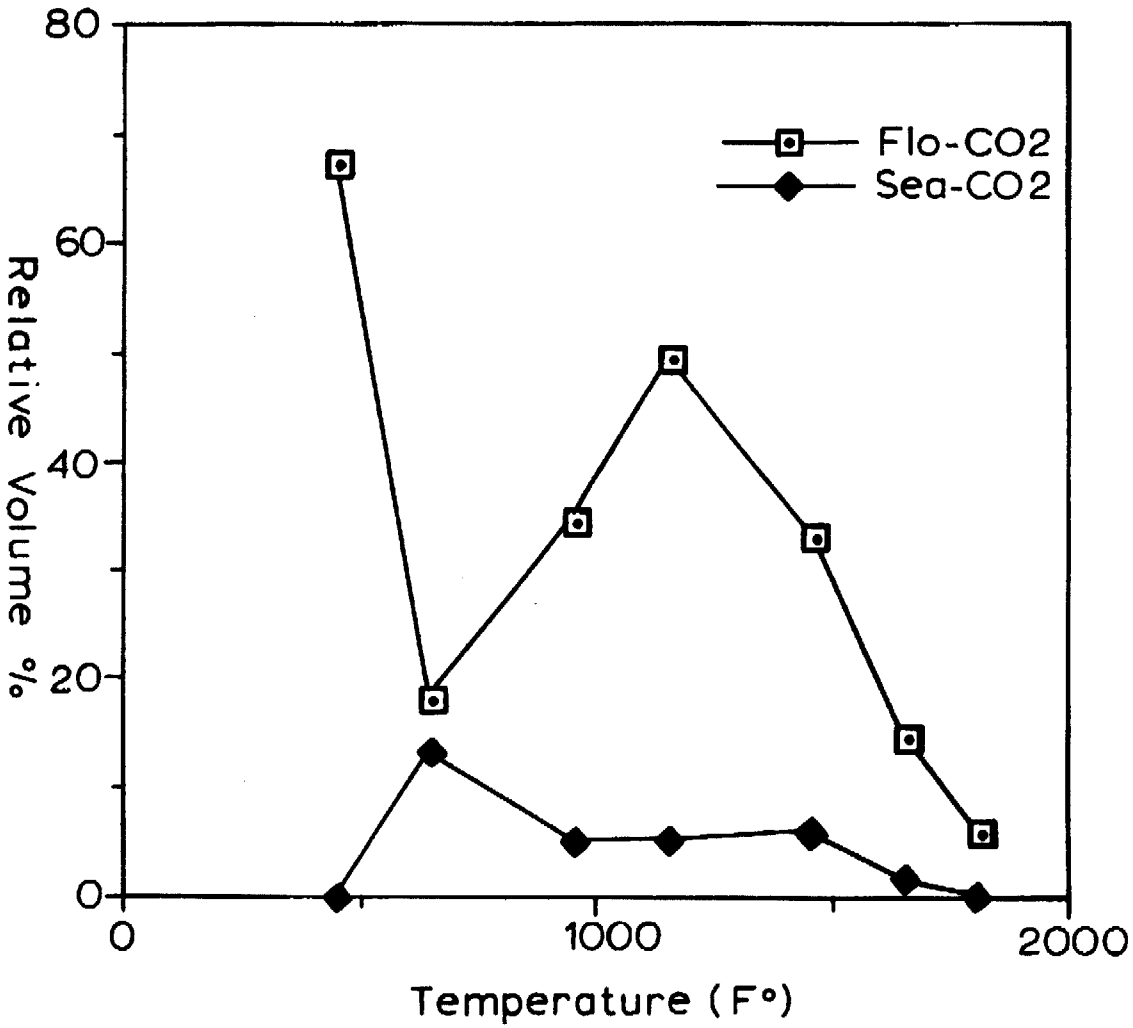
FIG. 5 is a graph of carbon dioxide ($CO_2$) generated from FLOCARB® and SEACOAL at various metal casting temperatures.

In the graphs of FIGS. 1–9, the preferred FLOCARB (oxidized lignite) is compared with a common foundry sand additive SEACOAL, examined at various temperatures. As shown in FIG. 2, the FLOCARB (oxidized lignite) generates, cumulatively, about 25–50% less benzene than SEACOAL over the common molten metal casting temperatures of 500°–2000° F. Most of the benzene generated during the heating is generated at a temperature above 950° F. FIGS. 3 and 4 show the capacity of the FLOCARB (oxidized lignite) to liberate carbon monoxide (CO) and methane ($CH_4$), respectively, over the same temperature range. FLOCARB (oxidized lignite) generates a large amount of water near 500° F. The formation of activated carbon not only requires the right types of gases to activate carbon surfaces ($H_2O$ (steam), $CO_2$), but also the gases must be generated in a particular sequence. The generation of the activating gases must precede the sorbate volatiles (benzene and the like) in order to produce a functional activated carbon material. In the oxidized lignite, both steamed $H_2O$ and $CO_2$, activating gases for carbon materials, are evolved from the lignite at about 500° F. and are interpreted to change the admixed graphite and other candidate carbons prior to the major phase of benzene generation in the lignite, occurring at temperatures above about 950° F., and SEACOAL, occurring at temperatures above about 1150° F. This sequence of gas evolution is the central phenomenon describing the benefit of a blended carbon product, consisting of oxidized lignite and graphite/carbon, for the development of an in-situ active carbon during combustion processes. FIG. 5 shows the substantial capacity of oxidized leonardite to liberate $CO_2$ within the temperature range of about 900° F. to about 2000° F., in comparison to SEACOAL, for faster in-situ activation (oxidation) of the carbon or graphite in accordance with the present invention. Accordingly, if SEACOAL is used as the humic source, a higher percentage of SEACOAL, e.g., 50%–90% based on the total weight of SEACOAL plus humic source would be required.

Figure 6:
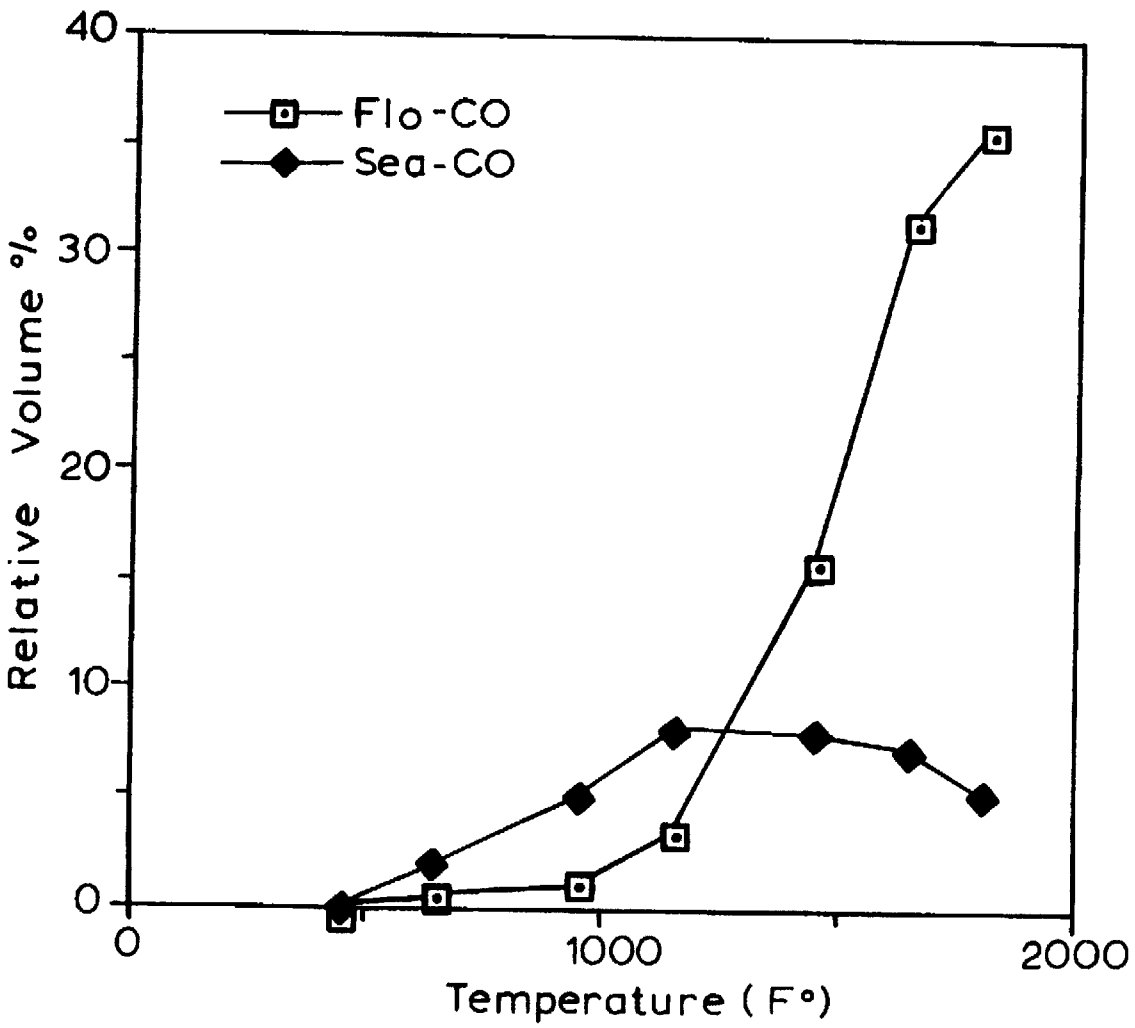
FIG. 6 is a graph of carbon monoxide (CO) generated from FLOCARB® and SEACOAL at various metal casting temperatures.
Figure 9:
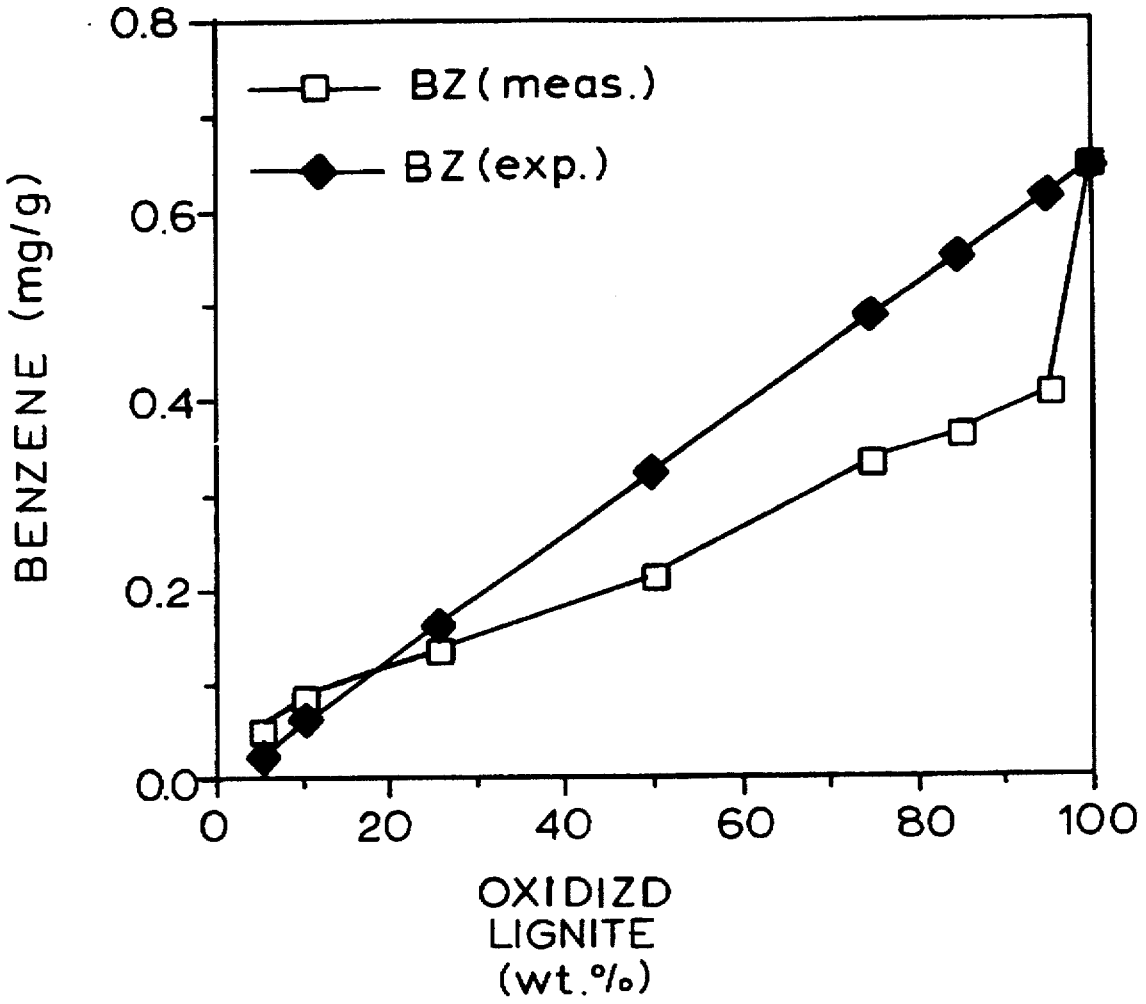
FIG. 9 is a graph comparing expected and measured benzene content for the combination of FLOCARB® and graphite (FLOCARB® II) foundry sand additives at various percentages of oxidized lignite.
Figure 10:
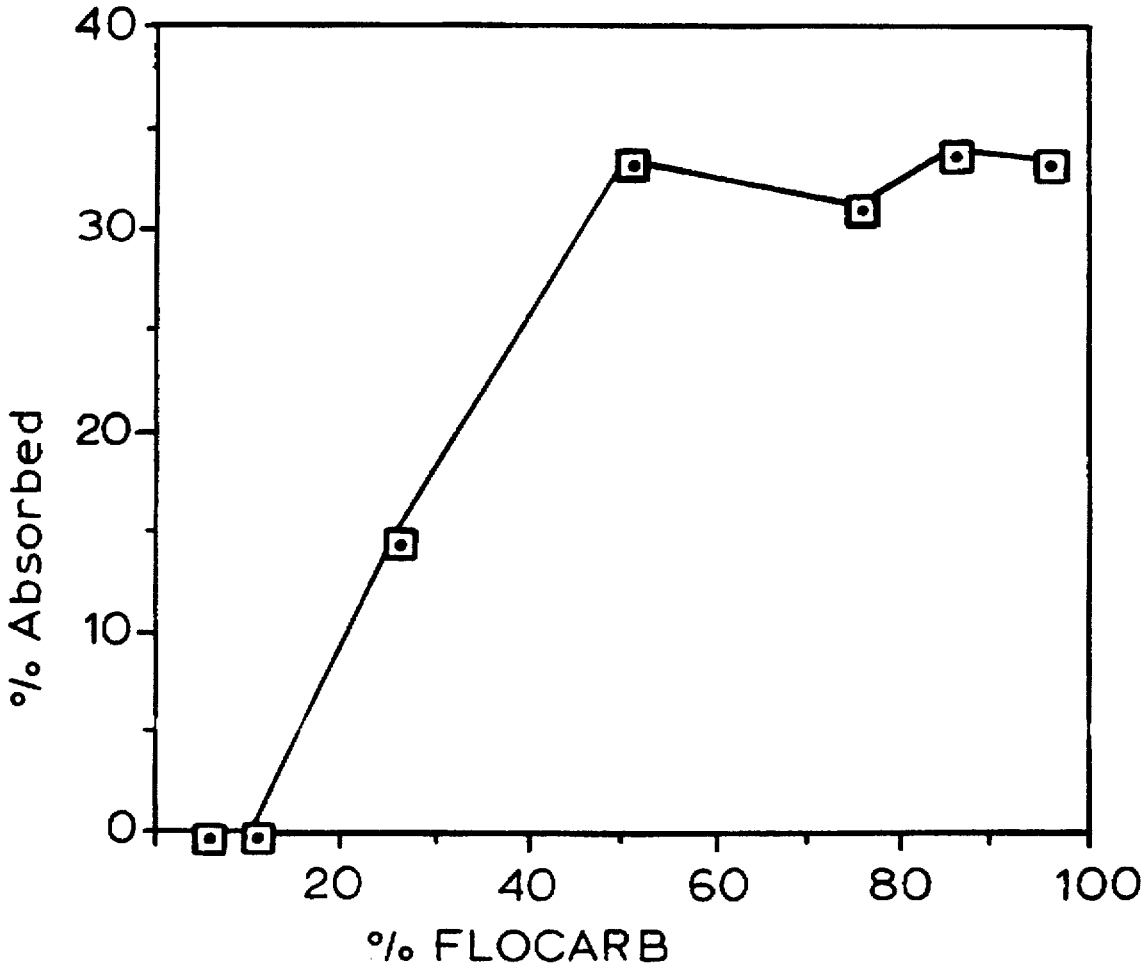
FIG. 10 is a graph showing the percentage of benzene absorbed by the combination of FLOCARB® and graphite (second generation of FLOCARB®) at various percentages of FLOCARB® (the remaining percentage being graphite).

FIG. 6 shows the substantially increased capacity of oxidized lignite to liberate CO at foundry molding temperatures of about 1250° F. to about 2000° F. in comparison to SEACOAL. FIGS. 7 and 8 show the overall gas generation (CO, $CO_2$ and $CH_4$) for FLOCARB and SEACOAL, over the temperature range of about 500° F. to about 1800°–2000° F. Note that $CO_2$ generation in SEACOAL is less significant than for oxidized lignite, and particularly so prior to the generation of benzene in SEACOAL. FIG. 10 shows data that is quite surprising for a combination of graphite and oxidized leonardite (as the humic acid-containing ore), showing the percentage of oxidized leonardite on the abscissa, with the remainder (to 100%) being graphite or carbon. These data are consistent with the above interpretation of evolved gases and molecules from this blended carbon system. The curve illustrates benzene emissions, in this case, assuming no interaction between components. The actual measured data reveal a lower amount of emitted benzene (at least about 30% less than expected (Table I), for blends that contain at least 50% oxidized lignite). This is due to the fact that the oxidized leonardite has, in-situ, activated the graphite such that the activated graphite has sorbed a surprisingly high portion of the benzene from the oxidized leonardite.

TABLE 1

Predicted and Measured Benzene Content (mgBen/g) for Leonardite and Graphite

| % Leonardite | Measured Benzene Content | Predicted Benzene Content | % Absorbed |
|---|---|---|---|
| 5 | 0.0513 | 0.0256 | 0% |
| 10 | 0.0866 | 0.0646 | 0% |
| 25 | 0.1380 | 0.1615 | 14.6% |
| 50 | 0.2149 | 0.3230 | 33.5% |
| 75 | 0.3327 | 0.4845 | 31.3% |
| 85 | 0.3622 | 0.5491 | 34.0% |
| 95 | 0.4080 | 0.6137 | 33.5% |
| 100 | 0.6460 | 0.6460 | 0% |

What is claimed is:

1. A foundry sand comprising:

a sand selected from silica sand, olivine sand, zircon sand, chromite sand, carbon sand, fluid coke sand, or mixtures thereof in an amount of about 70% to about 95% weight;

a binder for the sand in an amount of about 1% to about 15% by weight;

a ground ore containing a compound selected from humic acid, a metal salt of humic acid, or mixtures thereof, in an amount of about 0.1% to about 10% by weight; and a carbon source selected from the group consisting of carbon, graphite, and mixtures thereof, in an amount of about 0.1% to about 10% by weight, wherein the foundry sand has proportions of ground ore to carbon source of 20–95% by weight ground ore to about 80–5% by weight carbon source.

2. The foundry sand of claim 1, wherein the carbon source is not activated until heated by casting molten metal, at a temperature of about 450° F. to about 2300° F., against said foundry sand.

3. The foundry sand of claim 1, wherein the proportions of ground ore to carbon source are 25–95% by weight ground ore and 75–5% by weight carbon source.

4. The foundry sand of claim 3, wherein the proportions of ground ore to carbon source are 35–85% by weight ground ore and 65–15% by weight carbon source.

5. The foundry sand of claim 4, wherein the proportions of ground ore to carbon source are 50–80% by weight ground ore and 50–20% by weight carbon source.

6. A method of increasing the capacity of a carbon source to absorb organic gases, said carbon source selected from the group consisting of carbon, graphite, and mixtures thereof, comprising mixing the carbon source with sand and a ground ore containing a compound selected from humic acid, a metal salt of humic acid, or mixtures thereof, in weight proportions of 20–95% by weight ore to 80–5% by weight carbon source, herein the sand comprises about 70% to about 95% by weight, and heating the carbon source, sand and ore mixture to a temperature at least about 450° F.

7. The method of claim 6, wherein the organic gas comprises benzene.

8. The method of claim 6, wherein the proportions of ore to carbon source are 25–95% by weight ground ore and 75–5% by weight carbon source.

9. The method of claim 8, wherein proportions of ground ore to carbon source are 35–85% by weight ground ore and 65–15% by weight carbon source.

10. The method of claim 9, wherein the proportions of ground ore to carbon source are 50–80% by weight ground ore and 50–20% by weight carbon source.

11. The method of claim 8, wherein the mixture is heated by contact with molten metal at a temperature of about 450° F. to about 2300° F.

12. The method of claim 9, wherein the carbon source, sand and ore mixture is heated by contact with molten metal at a temperature of about 500° F. to about 2000° F.

13. The method of claim 10, wherein the carbon source, sand and an ore mixture is heated by contact with molten metal at a temperature of about 600° F. to about 2000° F.

14. A method of casting molten metal, while decreasing an amount of volatile organic compounds escaping from a casting mold, comprising forming a foundry sand in a foundry sand mold shape, said foundry sand including a sand selected from silica sand, olivine sand, zircon sand, chromite sand, carbon sand, fluid coke sand, or mixtures thereof in an amount of about 70% to about 95% by weight; a binder for the sand in an amount of about 1% to about 15% by weight; a ground ore containing a compound selected from humic acid, a metal salt of humic acid, or mixtures thereof, in an amount of about 0.1% to about 10% by weight; and a carbon source selected from the group consisting of carbon, graphite and mixtures thereof, in an amount of about 0.1% to about 10% by weight; and casting molten metal against the foundry sand mold at a temperature of about 450° F. to about 2300° F. to activate the carbon source for absorbance of volatile organic compounds formed during casting.

* * * * *